US005191671A

United States Patent [19]

Rudnick

[11] Patent Number: 5,191,671

[45] Date of Patent: Mar. 9, 1993

[54] TOOTHBRUSH HANDLE

[76] Inventor: Martin E. Rudnick, 2353 Rupert Dr., San Jose, Calif. 95124

[21] Appl. No.: 748,597

[22] Filed: Aug. 22, 1991

[51] Int. Cl.[5] ..... A46B 05/02

[52] U.S. Cl. ..... 15/167.1; 15/143.1

[58] Field of Search ..... 15/143 R, 167.1, 167.2, 15/143.1

[56] References Cited

U.S. PATENT DOCUMENTS

| | | | |
|---|---|---|---|
| Re. 22,938 | 11/1947 | Kisky . | |
| D. 93,044 | 8/1934 | Parkhurst et al. . | |
| D. 136,156 | 8/1943 | Fuller | D4/104 |
| D. 140,438 | 2/1945 | Cohen . | |
| D. 238,834 | 2/1976 | Hjelle . | |
| D. 240,981 | 8/1976 | Hill | D4/104 |
| D. 241,891 | 10/1976 | Cannon et al. . | |
| D. 257,192 | 10/1980 | Moses | 15/167.1 |
| D. 265,526 | 7/1982 | Hyman | D4/112 |
| D. 272,679 | 2/1989 | Stocchi . | |
| D. 272,691 | 2/1989 | Stocchi . | |
| D. 293,859 | 1/1988 | Gjerde . | |
| 140,429 | 7/1873 | O'Donoghue et al. . | |
| 2,304,319 | 12/1942 | Saltzman | 15/143 R |
| 2,317,485 | 4/1943 | Rider | 15/167.1 |
| 4,010,509 | 3/1977 | Huish . | |
| 4,306,327 | 12/1981 | Zeski . | |
| 4,519,109 | 5/1985 | Raymond | 15/167.1 |
| 4,519,111 | 5/1985 | Cavazza . | |
| 4,672,706 | 6/1987 | Hill | 15/143 R |
| 5,040,261 | 8/1991 | Kirberger | 15/167.1 |

FOREIGN PATENT DOCUMENTS

| | | | |
|---|---|---|---|
| 3620846A1 | 12/1987 | Fed. Rep. of Germany . | |
| 8806417 | 2/1988 | PCT Int'l Appl. | 15/143 R |
| WO89/10076 | 4/1989 | PCT Int'l Appl. . | |
| 672052 | 10/1989 | Switzerland . | |
| 673516 | 6/1952 | United Kingdom . | |
| 705725 | 3/1954 | United Kingdom . | |

*Primary Examiner*—James E. Bryant, III
*Assistant Examiner*—Terrance R. Till
*Attorney, Agent, or Firm*—Townsend and Townsend

[57] ABSTRACT

An improved toothbrush (10) includes an elongated handle (12) having a proximal end (14) and a distal end (16), and a longitudinal axis (18) extending therebetween. A head (20) is attached to the distal end of the handle and has a top surface (24) and bottom surface (34). A plurality of bristle tufts (22) are attached to the top surface of the head. The handle has a transverse cross section adjacent the proximal end in the shape of a trapezoid that has a bottom edge, a top edge, and side edges extending from the bottom edge to the top edge. The top edge is smaller than the bottom edge.

10 Claims, 2 Drawing Sheets

TOOTHBRUSH HANDLE

BACKGROUND OF THE INVENTION

The present invention is directed to a toothbrush having an improved handle.

Toothbrushes generally include a handle, a head that carries a plurality of bristle tufts, and a neck that connects the handle and the head. The geometry of the head relative to the handle varies from being co-linear to being disposed at an angle. For example, U.S. Pat. No. 4,306,327 describes a toothbrush having a neck region angled at approximately fifteen degrees relative to the handle designed to reach and evenly brush the teeth. As this patent states, when a straight toothbrush is held normally, the longitudinal axis of the brush lies at an angle that makes it virtually impossible to effectively manipulate the toothbrush to clean the molars and gums at the rear of the mouth.

Another toothbrush design is shown in Swiss Patent CH 672,052, which describes a neck region that attaches the handle to the head which carries bristles, and raises top of the head relative to the handle.

U.S. Re. No. 22,938 shows a toothbrush design that has inclined surfaces that run along the entire length of the handle and head. Bristles are attached to the inclined surfaces of the head.

Effective brushing has been accomplished in other toothbrush designs by having shaped heads and bristle tufts arrangements. For instance, U.S. Des. No. 272,679 shows a toothbrush having bristle tufts that decrease in length from the rear end toward the far end of the head. In another prior-art toothbrush, the bristle tufts vary in length from row to row, as shown in U.S Des. No. 272,691.

There exists a need for a toothbrush that effectively cleans teeth while being comfortable to use and having sufficient strength. The present invention fulfills this and other needs.

SUMMARY OF THE INVENTION

In one aspect of the invention, a toothbrush includes an elongated handle having a proximal end and a distal end, and a longitudinal axis extending therebetween. A head is attached to the distal end of the handle and has a top surface and bottom surface. A plurality of bristle tufts are attached to the top surface of the head. The handle has a transverse cross section adjacent the proximal end in the shape of a trapezoid. The trapezoid has a bottom edge having a bottom dimension, a top edge having a top dimension, and side edges extending from the bottom edge to the top edge. The top edge is smaller than the bottom edge.

In a preferred embodiment, the handle further includes a second trapezoidal cross section adjacent the distal end. The second trapezoid includes a second bottom edge, a second top edge, and second side edges extending from the second bottom edge to the second top edge, the second top edge is smaller than the second bottom edge. The second top edge is smaller than the top edge, and the second bottom edge is smaller than the bottom edge. Preferably, the height of the first trapezoidal cross section is larger than the height of the second trapezoidal cross section. As defined by these relationships the handle tapers in thickness from the proximal to the distal end.

The invention provides a handle having sloping sides that aid in the orientation of the bristles in the mouth.

Once properly oriented, the shape of the handle allows easy maintenance of this orientation by providing gripping surfaces that mate with the fingers of the user. The handle continuously tapers to the head allowing the toothbrush to be easily and comfortably inserted into the mouth. The trapezoidal cross section also provides strength to the distal end of the handle.

In another aspect of the invention, a toothbrush includes a handle and a head. The handle has a proximal end, a distal end and a trapezoidal cross-sectional shape with a top surface, a bottom surface and lateral side surfaces that slope upwardly and inwardly from the bottom surface to the top surface. The head extends from the distal end of the handle and has a top surface, a bottom surface and bristles extending from the top surface.

In another aspect of the invention, a toothbrush includes a handle and a head. The handle has a proximal end, a distal end and a trapezoidal cross-sectional shape with a top surface, a bottom surface and lateral side surfaces sloping upwardly and inwardly from the bottom surface to the top surface. The handle tapers from the proximal end to the distal end, and the proximal end being larger than the distal end. The cross-sectional area of the handle at the proximal end is substantially larger than the cross-sectional shape of the handle at the distal end. The head extends from the distal end of the handle, and has a top surface, a bottom surface and bristles extending from the top side.

DESCRIPTION OF THE PREFERRED EMBODIMENT

Brushing the teeth is perhaps one of the most important aspects of daily hygiene and is often the most neglected and improperly performed. Improper use of a toothbrush provides ineffective cleaning and can even destroy teeth. A toothbrush functions by having the individual bristles dislodge the foreign material on the surface of the tooth or gum. The mouth has many regions where the surfaces of teeth are oriented in different directions. Proper cleaning requires that the bristles contact the teeth at an effective orientation and with sufficient force to dislodge foreign material. Subsequent rinsing removes the foreign material completely from the mouth.

Figures 1, 2, 3, 4, 5, 6, 7:
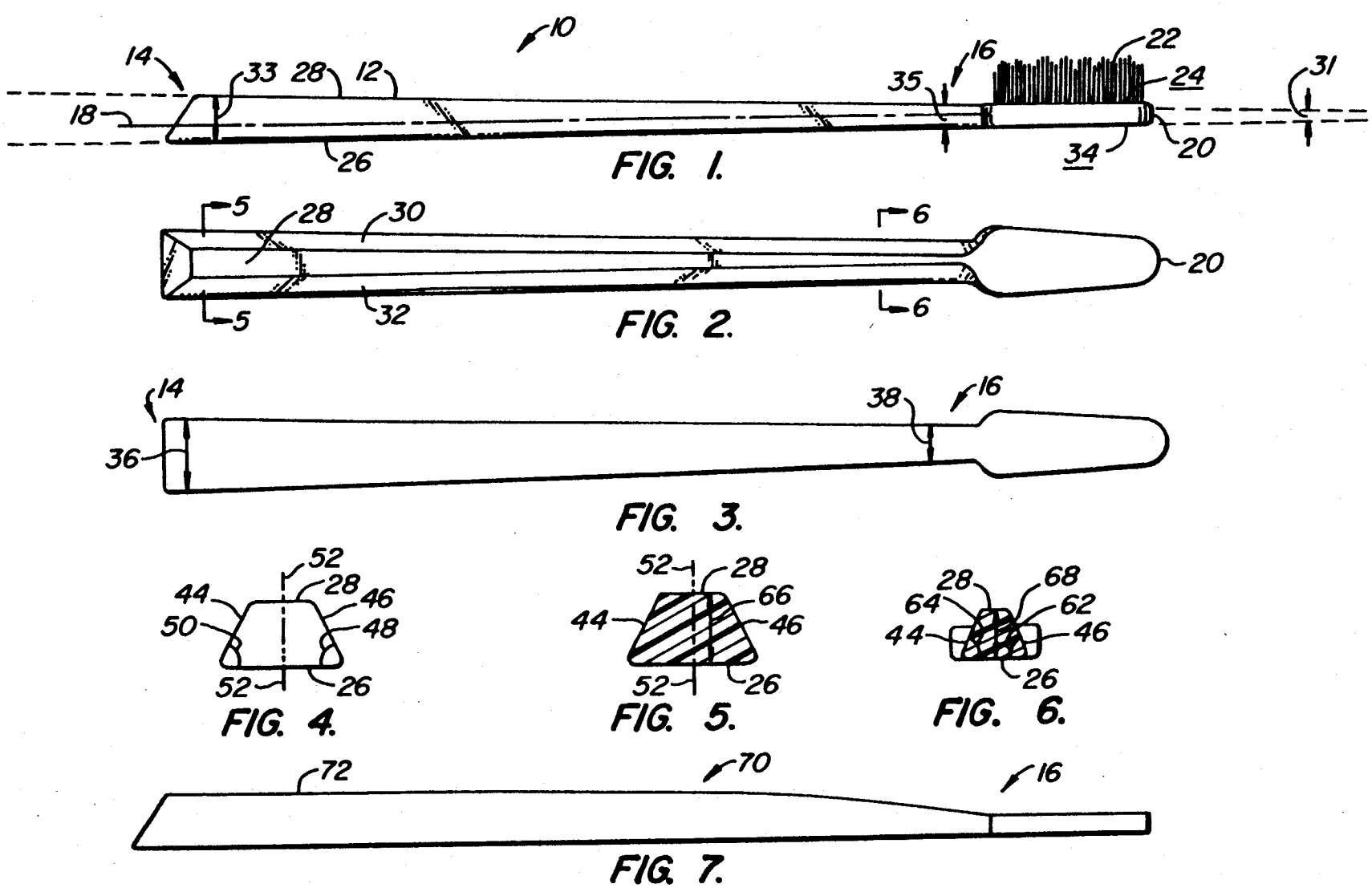
FIG. 1 is a side view of the toothbrush of the present invention.
FIG. 2 is a plan view of the toothbrush of FIG. 1 having the bristle tufts removed.
FIG. 3 is a bottom view of the toothbrush of FIG. 1.
FIG. 4 is view the distal end of the toothbrush handle.
FIG. 5 is a transverse sectional view of the toothbrush taken along line 5—5 of FIG. 2.
FIG. 6 is a transverse sectional view of the toothbrush taken along line 6—6 of FIG. 2.
FIG. 7 is side view of an alternate embodiment of the invention.

Referring to FIG. 1, a toothbrush 10 of the present invention consists of a handle 12 having a proximal end 14 and a distal end 16, and longitudinal axis 18 extending therebetween. A head 20 is attached to distal end 16 and is adapted to accommodate a plurality of bristle tufts 22 extending from its upper surface 24. Handle 12 and head 20 together form a substantially rigid member adapted to transmit force applied to the handle to the head and, in turn, to the bristle tufts. Typically, the head is integrally formed with the handle and is made of a suitable natural or synthetic material, such as a polyacrylamide, as is known in the art. The handle is typically molded from the desired material to form a solid member, although in alternative embodiments, separate members can be assembled to form a hollow handle.

A plurality of bristle tufts 22 are inserted into holes (not shown) or molded directly into the upper surface of the head. Bristle tufts suitable for use with the invention are made of synthetic materials such as nylon or "Tynex" (DuPont & Nemors, Wilmington, Del.), as is known in the art. Within a bristle tuft, bristles of differing lengths are generally grouped together to form a blunt end. In turn, bristle tufts are arranged in rows that are disposed adjacent one another to form a bristle array on the upper surface of the head. The average length of adjacent bristle tufts and the angle between the upper surface of the head the bristle tufts are chosen according to methods known in the art. For instance, a suitable arrangement of bristle tufts may form a bristle array having adjacent rows of bristle tufts with differing lengths.

Referring now to FIGS. 1 and 2, handle 12 includes a base member 26, a top member 28, and two sloping side members 30 and 32. Base member 26 is disposed parallel to longitudinal axis 18 and extends from proximal end 14 to distal end 16. In a preferred embodiment, as shown in FIG. 1, base member 26 is continuous with the bottom surface 34 of head 20. Such an arrangement provides for a smooth transition without ridges that can irritate the lips and mouth. Top member 28 is disposed at an angle 31 relative to base member 26 and, thus, the handle tapers from an initial thickness 33 adjacent proximal end 14 to a final thickness 35 distal end 16. The magnitude of the angle 31 and, hence, the amount of taper is chosen to allow the average sized hand to comfortably grip the handle, as discussed below.

As shown in FIG. 3, base member 24 gradually tapers along the longitudinal axis from an initial width 36 adjacent proximal end 14 of the handle to a final width 38 adjacent end 16. The initial width 36 in combination with the final width 38 determines the general size and shape of the handle and are chosen to accommodate a wide variety of hand sizes. The final width 38 and thickness 35 determine the strength of the distal end of the toothbrush handle as well as the overall taper of the handle.

As discussed above, head 20 is attached to the distal end of the handle. A particular advantage of the handle taper is that a neck is not needed to connect the head and handle. The tapering provides substantial strength at the distal end of the handle while being narrow enough to fit comfortably within the mouth.

Now referring to FIG. 1, top 28 is disposed opposite base 26 and is longitudinally oriented relative to base 26 by an angle 31. Angle 31 is of a magnitude such that the resulting handle is gripped and oriented as described below, while maintaining sufficient strength at the distal end of the handle. In a preferred embodiment, angle 31 has a magnitude between 0 and 10 degrees, most preferably between 0 and 5 degrees. In a particularly preferred embodiment, angle 31 has a magnitude of approximately 1 degree. As shown in FIG. 4, however, the top and bottom members are transversely parallel. A more detailed description of the handle is described relative to cross-sectional views taken perpendicular to longitudinal axis 18.

Referring to the end view shown in FIG. 4 and the transverse sectional view shown in FIG. 5, handle 12 has a trapezoid cross section. Side edges 44 and 46 of the toothbrush handle are oriented at respective angles 48 and 50 relative to bottom edge 26, and top edge 28 and bottom edge 26 are parallel. Thus, the cross section defines a trapezoid. The magnitude of each angle is chosen to allow the resulting handle to be gripped and oriented as described below. In a preferred embodiment, angles 48 and 50 have equal magnitudes and form a trapezoid having a line of symmetry 52—52. In a further preferred embodiment, each of the angles 48 and 50 has a magnitude between 45 and 80 degrees, preferably between 55 and 70 degrees, most preferably approximately 60 degrees.

FIG. 6 is a transverse sectional view of the toothbrush handle at line 6—6 of FIG. 2, closer to distal end 16 of handle 12. Due to the longitudinal tapering of handle 12, the top, bottom, and side edges 28, 26, 44 and 48, respectively, of the trapezoidal cross section are smaller than their corresponding edges in FIG. 5. Angles 62 and 64, however, are substantially the same as corresponding angles 48 and 50 of the transverse cross section of FIG. 5. In conjunction with the cross-sectional description, the trapezoid of the sectional view of FIG. 5 has an height 66, while the trapezoid of the cross-sectional view of FIG. 6 has an height 68. Due to the tapering of the handle, height 68 is smaller than height 66.

In a preferred embodiment, the taper in thickness and width is monotonic and substantially linear, as shown in FIGS. 1 and 2, creating smooth surfaces along the length of the handle with no edges, points, or ridges to irritate the mouth. In another preferred embodiment, the taper in thickness is curved toward distal end 16, as shown in FIG. 7. In a region adjacent the proximal end of the handle, the upper surface 72 is substantially linear. In an intermediate region 70 between the proximal and distal ends, the upper surface curves toward the bottom surface. Other suitable tapers that provide a smooth transition from the proximal end of the handle to the head may be used.

Figure 8:
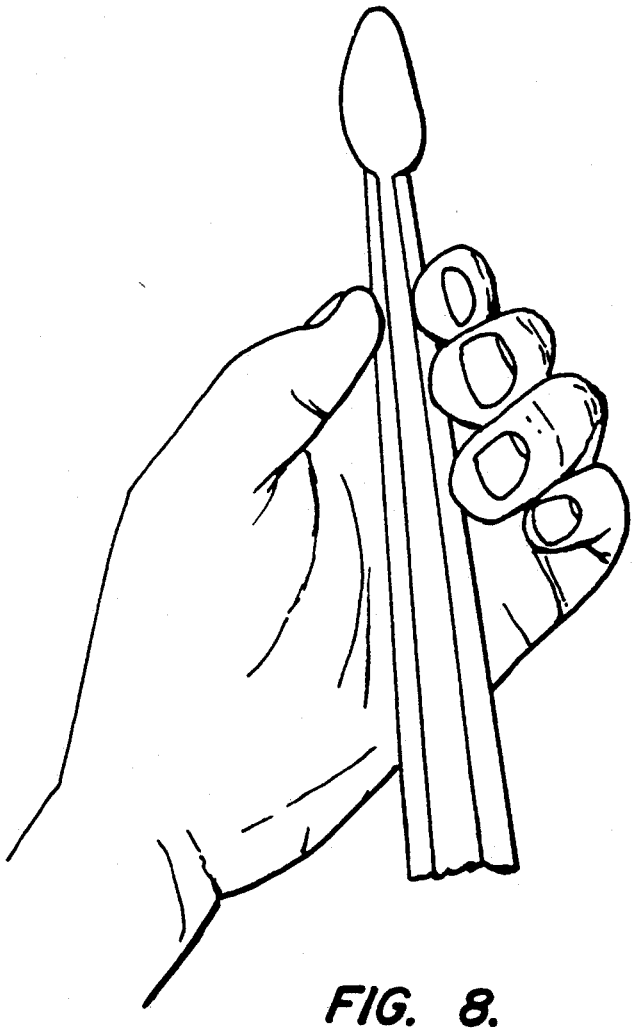
FIG. 8 is a perspective view showing a hand holding the toothbrush of FIG. 1

The trapezoidal cross section confers many advantageous properties on the handle. For example, the sloping sides provide convenient rests for fingers to grip the handle and orient the bristle tufts in the mouth. FIG. 8 shows one of the possible ways to hold and orient the handle. Because of the tapering thickness and width and trapezoidal shape, the handle is easily held in position by hands of varying sizes. Small hands, for example, grasp handle 12 near distal end 16, while larger hands grasp the handle closer to the proximal end 14. In this way, the toothbrush can accommodate hands of varying sizes and shape. The handle shape further ensures that the distal end of the handle is the region between the hand and head has sufficient strength to prevent excessive elastic deformation or breakage.

Other embodiments will be apparent to one of skill in the art after review of this disclosure.

What is claimed is:

1. A toothbrush comprising:

a. an elongated handle having a proximal end and a distal end, and a longitudinal axis extending therebetween, the handle comprising:

a transverse cross section adjacent said proximal end in the shape of a trapezoid, wherein said trapezoid comprises a bottom edge, a top edge, and side edges extending from said bottom edge to said top edge, said top edge being smaller than said bottom edge, and a second transverse cross section adjacent said distal end in the shape of a second trapezoid, said second trapezoid comprising a second bottom edge, a second top edge, and second side edges extending from said second bottom edge to said second top edge, said second top edge being smaller than said second bottom edge, wherein said second top edge is smaller than said top edge, and said second bottom edge is smaller than said bottom edge, whereby said handle tapers in width from said proximal end to said distal end;

b. a head attached to the distal end of said handle, said head having a top side and a bottom side, said top side being contiguous with said second top edge, and said bottom side being continuous with said second bottom edge;

c. a plurality of bristle tufts attached to the top side of said head.

2. The toothbrush of claim 1 wherein the height of said trapezoidal cross section is larger than the height of said second trapezoidal cross section, whereby said handle tapers in thickness from said proximal end to said distal end.

3. The toothbrush of claim 1 wherein the side edges of said trapezoid are disposed at angles having substantially equal magnitudes measured relative to said bottom edge.

4. The toothbrush of claim 3 wherein the magnitudes of said angles are between 30 and 60 degrees.

5. The toothbrush of claim 4 wherein the magnitudes of said angles are approximately 60 degrees.

6. The toothbrush of claim 1 wherein cross sections perpendicular between said proximal and distal ends are trapezoidal.

7. A toothbrush comprising:

a handle having a proximal end portion a distal end and a trapezoidal cross-sectional shape from said proximal end portion to said distal end with a top surface, a bottom surface and lateral side surfaces sloping upwardly and inwardly from the bottom surface to the top surface; and a head, extending from the distal end of the handle having a top surface, a bottom surface and bristles extending from the top surface, said head top surface being contiguous with said handle top surface, and said head bottom surface being continuous and generally coplanar with said handle bottom surface.

8. A toothbrush comprising:

a handle having a proximal end portion, a distal end and a trapezoidal cross-sectional shape from said proximal end portion to said distal end with a top surface, a bottom surface and lateral side surfaces sloping upwardly and inwardly from the bottom surface to the top surface;

a head, extending from the distal end of the handle, having a top surface, a bottom surface and bristles extending from the top surface, said head top surface being continuous with said handle top surface and said head bottom surface being continuous with said handle bottom surface; and the handle tapering from the proximal end portion to the distal end, the proximal end portion being larger than the distal end, the cross-sectional area of the handle at the proximal end portion being substantially larger than the cross-sectional shape of the handle at the distal end.

9. The toothbrush of claim 8 wherein the handle tapers linearly from the proximal end portion to the distal end with an included angle between the top surface and the bottom surface of about 0 to 10 degrees.

10. The toothbrush of claim 8 wherein said cross-sectional area of the handle at the proximal end portion is at least about 10 percent to 100 percent larger than said cross-sectional area of the handle at the distal end.

* * * * *